US006325646B1

(12) United States Patent
Uemura et al.

(10) Patent No.: US 6,325,646 B1
(45) Date of Patent: Dec. 4, 2001

(54) POWER PLUG ASSEMBLY HAVING A PLUG THAT IS LIFTED UP WHEN PLUGGED INTO AN OUTLET

(75) Inventors: Kazuki Uemura; Katsutoshi Inada, both of Iizuka; Kazuo Yoneyama, Kyoto, all of (JP)

(73) Assignees: Nintendo Co., Ltd., Kyoto-Fu; Mitsumi Electric Co., Ltd., Tokyo, both of (JP)

( * ) Notice: Subject to any disclaimer, the term of this patent is extended or adjusted under 35 U.S.C. 154(b) by 0 days.

(21) Appl. No.: 09/711,948

(22) Filed: Nov. 15, 2000

(30) Foreign Application Priority Data

Nov. 17, 1999 (JP) ..... 11-326902

(51) Int. Cl.[7] ..... H01R 13/44; H01R 13/60; H01R 29/00

(52) U.S. Cl. ..... 439/131; 439/172

(58) Field of Search ..... 439/131, 172

(56) References Cited

U.S. PATENT DOCUMENTS 5,135,406 * 8/1992 Ishikawa ..... 439/131
5,220,152 * 6/1993 Doran ..... 219/201
5,713,746 * 2/1998 Wu ..... 439/131
5,967,807 * 10/1999 Wu ..... 439/131
6,062,880 * 5/2000 Skuza ..... 439/131
6,179,633 * 1/2001 Inada ..... 439/131

* cited by examiner

*Primary Examiner*—Brian Sircus
*Assistant Examiner*—Chandrika Prasad
(74) *Attorney, Agent, or Firm*—Nixon & Vanderhye P.C.

(57) ABSTRACT

A power plug assembly houses a plug in such a manner so that the plug is lifted up when required. The plug is always biased in a direction so that it is housed due to the force exerted by a first resilient member. When the plug is pivotally moved to some extent, first and second engagement parts are structured to engage with each other so that the plug is retained in a state ready to be plugged into an AC outlet. When the plug is pulled out from the AC outlet, a user may release the engagement of parts so that the plug is automatically housed in a space due to the resilience of the first resilient member.

19 Claims, 5 Drawing Sheets

POWER PLUG ASSEMBLY HAVING A PLUG THAT IS LIFTED UP WHEN PLUGGED INTO AN OUTLET

BACKGROUND OF THE INVENTION

1. Field of the Invention

The present invention relates to power plug assemblies and, more specifically, to a power plug assembly which houses a plug in such a manner as to be lifted up when plugged into an AC outlet.

2. Description of the Background Art

A well known conventional type power plug assembly is one of which includes a plug which is lifted up, by 90 degrees, to be plugged into an AC outlet before use. The plug is arranged in a pivotally movable fashion in the body of assembly, and housed therein when not in use.

In such a conventional power plug assembly, a plug base and the body are arranged so that play therebetween is reduced. Friction is generated between the plug base and the body to hold the plug in a state ready to be plugged into the AC outlet. This is done to reduce the number of components of the assembly and to simplify the structure thereof. Some of the conventional power plug assemblies include engagement mechanisms for each of the plug base and the body which are partially made of resin. When the plug is pivotally moved to some extent, those two engagement mechanisms engage each other with the help of the elasticity of the resin, thus enabling the plug to be held and to remain in a plugged-in state with the AC outlet.

In the conventional power plug assembly, the plug is held in the plugged-in state due to friction generated between the plug base and the body, or the elasticity of the resin of the engagement mechanisms. In this manner, however, the plug (terminal) remains exposed from the body after use, and the plug needs to be manually pushed back into the body. If the plug is not pivotally moved enough to be housed back in the body, the plug still remains exposed, thus resulting in malfunction if something bumps against the plug.

For the power plug assembly that utilizes the elasticity of the resin for engagement, if the plug is lifted-up and pushed-back too often, the resin part may gradually wear out, and finally may not stay in a desired position.

SUMMARY OF THE INVENTION

In order to solve the above problems, a power plug assembly of the present invention comprises: a plug formed in one piece with a pair of terminals to be inserted into the AC outlet, and made of insulating material; a case which has a space for retaining the plug in a pivotally movable manner for a predetermined angular range, exposing the terminals when the plug pivotally moves, and housing the terminals when not in use; and a first resilient member housed in the case, and always biasing the plug in a direction to be housed. The power plug assembly further comprises: a first engagement part formed in the plug; a second engagement part to be engaged with the first engagement part when the plug is pivotally moved to a predetermined angle forced against the first resilient member; an engagement operation part for engaging the second engagement part with the first engagement part; and a second resilient member for always biasing the engagement operation part in a direction to release engagement.

When the plug is pivotally moved to the predetermined angle, a user operates the engagement operation part in a manner to produce a force against the resilience of the second resilient member so that the first and second engagement parts are engaged with each other and the plug is retained in a state ready for plug-in to the AC outlet. When the user releases the engagement operation part, the plug is automatically housed in the space due to resilience of the first resilient member.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
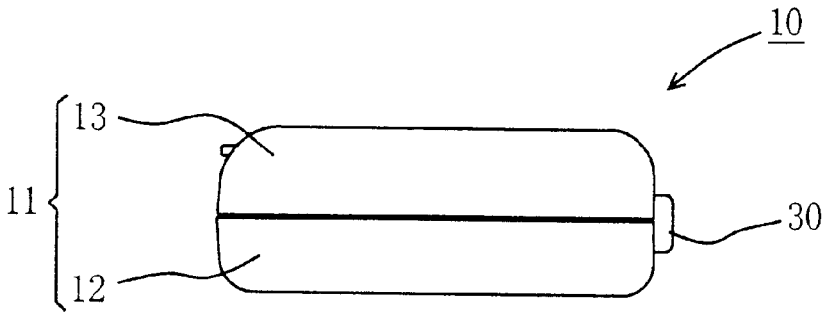
FIG. 1 is a plane view of a power plug assembly according to one embodiment of the present invention.
Figure 2:
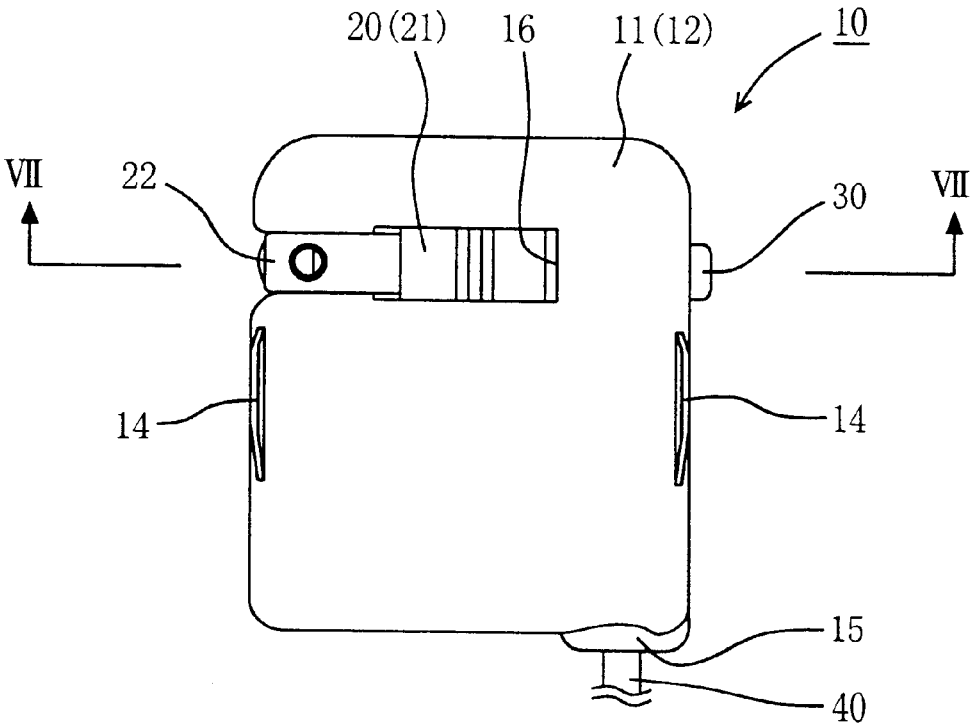
FIG. 2 is a front view of the power plug assembly of FIG. 1.
Figure 3:
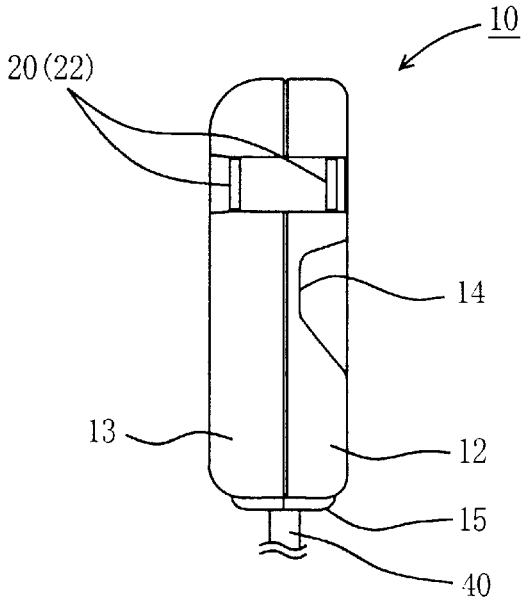
FIG. 3 is a left side view of the power plug assembly of FIG. 1.
Figure 4:
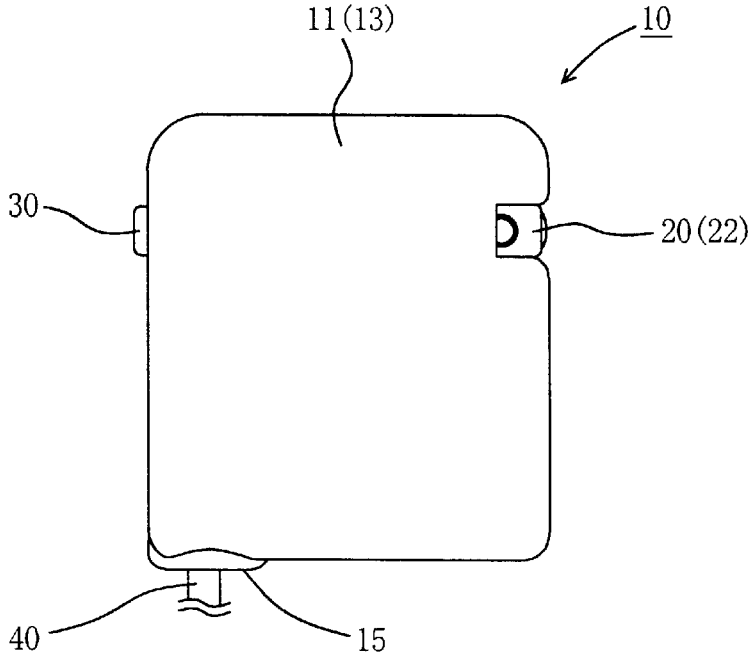
FIG. 4 is a rear view of the power plug assembly of FIG. 1.
Figure 5:
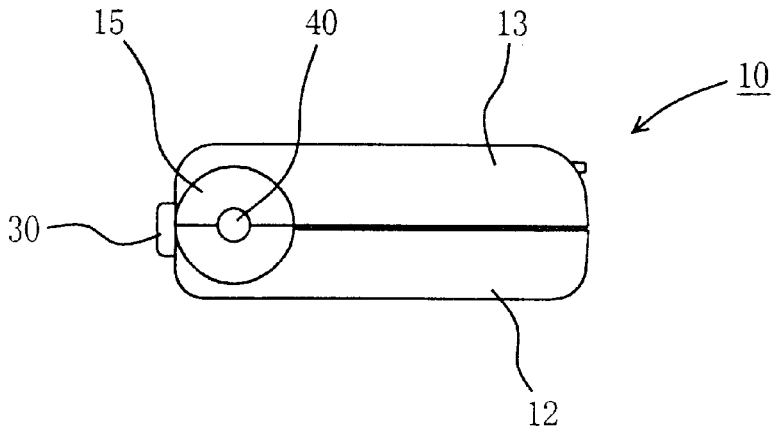
FIG. 5 is a bottom view of the power plug assembly of FIG. 1.
Figure 6:
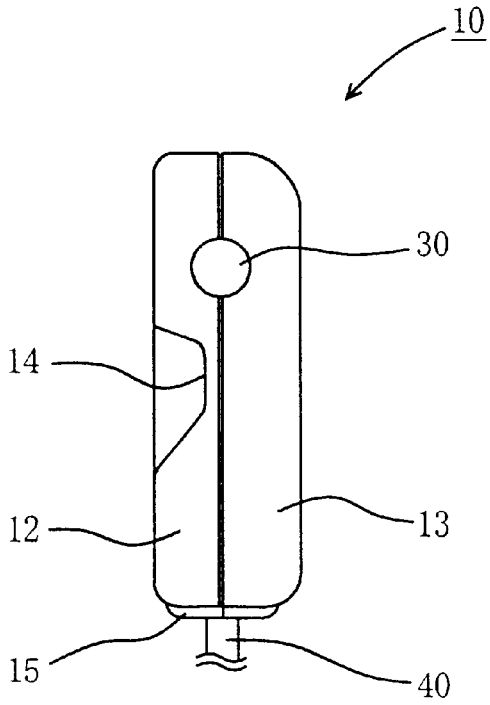
FIG. 6 is a right side view of the power plug assembly of FIG. 1.
Figure 7:
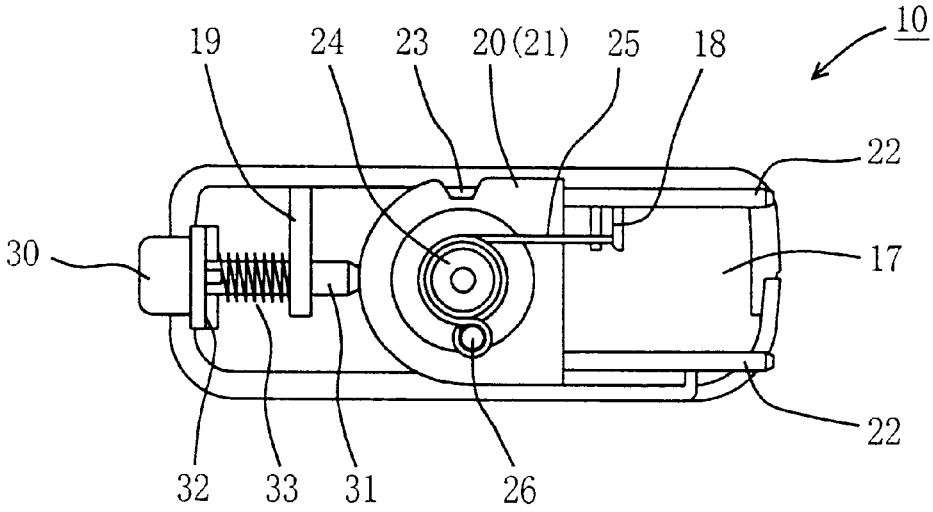
FIG. 7 is a section view of the power plug assembly taken along a line of VII—VII in FIG. 2.
Figure 8:
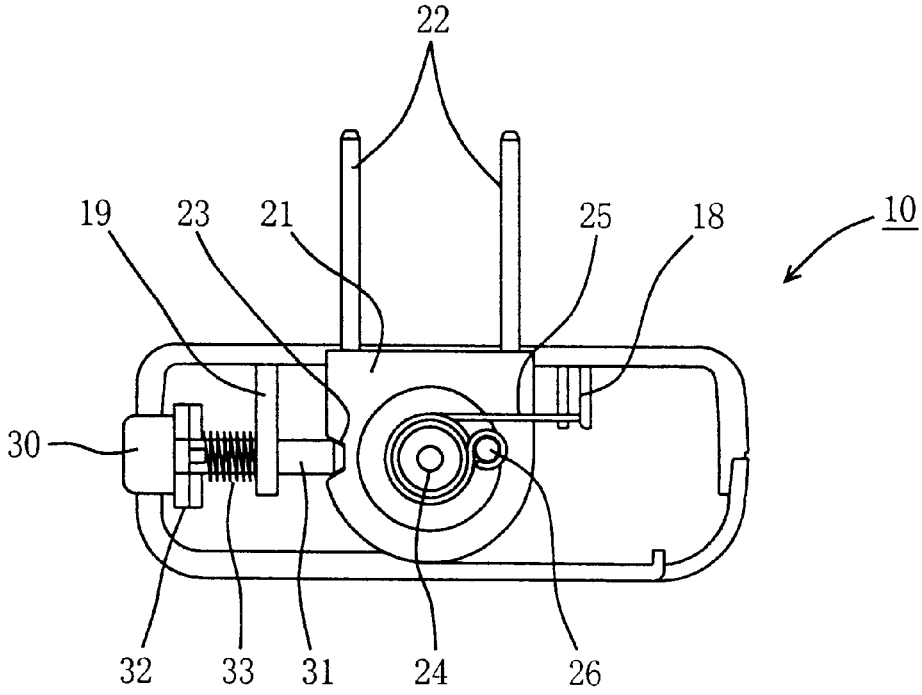
FIG. 8 is a view, for reference, showing how a plug pivotally moves.

FIGS. 1 to 8 show an exemplary embodiment in which a power plug assembly of the present invention is applied into an AC plug. Specifically, FIG. 1 is a plane view, FIG. 2 is a front view, FIG. 3 is a left side view, FIG. 4 is a rear view, FIG. 5 is a bottom view, FIG. 6 is a right side view, FIG. 7 is a section view taken along a line of VII—VII in FIG. 2, and FIG. 8 is a section view showing a plug of FIG. 7 pivotally moved and lifted up.

Referring now to FIGS. 1 to 6, an AC plug 10 includes a front-side half 12 and a rear-side half 13, which are both made of resin and are provided with two engagement portions 14 on the right and left sides. The front-side half 12 and the rear-side half 13 are assembled to form a case 11 through the engagement portions 14. A plug 20 is formed by a plug base 21 and a pair of terminals 22, and is retained in a pivotally movable fashion with respect to the case 11. A push-type button 30 is arranged on the right side of the case 11. The push-type button 30 is pushed to retain the plug 20 in a position so that it is ready for plug-in into an AC outlet. From the bottom of the case 11, a power cord 40 is pulled out and extends from a cord reel 15.

The plug 20 is lifted up frontward in FIG. 2 (rightward in FIG. 3) by fingers, for example, until abutting a wall 16 of the front-side half 12. When abutted against the wall 16, the plug 20 stands upright almost at 90 degrees. In this position, the plug 20 does not pivotally move to the rear-side half 13. The plug base 21 of the plug 20 abuts the internal side of the rear-side half 13. From the rear-side half 13, the tips of the terminals 22 are visible but not the plug 20 (see, e.g., FIG. 4).

Referring now to FIGS. 7 and 8, how the plug 20 pivotally moves is described below. A space 17 is provided in the case 11 for housing the terminals 22 of the plug 20 when not in use. The plug 20 is pivotable with respect to the case 11 about a pivot axis 24. A spring 25 is wound around the pivot axis 24. One end of the spring 25 is fixed to a protrusion 26 formed on the plug 20, and the other end of the spring 25 is engaged with another protrusion 18 formed on the internal side of the front-side half 12 in the space 17.

The button 30 is coupled to a pin 31 via a base 32. The pin 31 passes through a pin retention rib 19 protruding from the internal side of the front-side half 12, and protrudes toward the plug base 21. A spring 33 is sandwiched between the base 32 and the pin retention rib 19. The pin 31 passes through the spring 33. The spring 33 is resilient in a direction to separate the base 32 and the pin retention rib 19 from each other. When the button 30 is not pushed down, the spring 33 keeps the pin 31 away from the plug base 21.

The plug base 21 is formed with an engagement recess 23 to accept the pin 31 when the plug 20 pivotally moves by 90 degrees. As shown in FIG. 8, after the plug 20 is pivotally moved by 90 degrees to put the terminals 22 in a position to be plugged into the AC outlet, the pushing by the user on the button 30 causes the pin 31 to engage with the engagement recess 23. As a result, the plug 20 is held in the plug-in state (lifted up by 90 degrees) and is thus ready to be plugged into the AC outlet.

Once the terminals 22 were inserted into the AC outlet, the button 30 is released by the user. Then, the pin 31 is set free from engagement with the engagement recess 23 due to the spring's 33 resiliency in a direction to separate the pin retention rib 19 and the base 32 from each other. After the button is released, the plug 20 is ready to be in a non-use state (housed-in state) as shown in FIG. 7 due to the resilient spring 25. However, since the terminals 22 are in the AC outlet, the plug 20 is not allowed to be put back in such housed-in state.

The plug 20 can be automatically put back in the housed-in state only after the AC plug 10 is pulled out from the AC outlet. If the button 30 is not released when the AC plug 10 is pull-out from the AC outlet, the plug 20 remains standing in an upright position of 90 degrees. On the other hand, if the button 30 is released, the pin 31 is set free from the engagement with the engagement recess 23, and then the plug 20 is automatically put back in the housed-in state due to the resilient spring 25.

Figure 9:
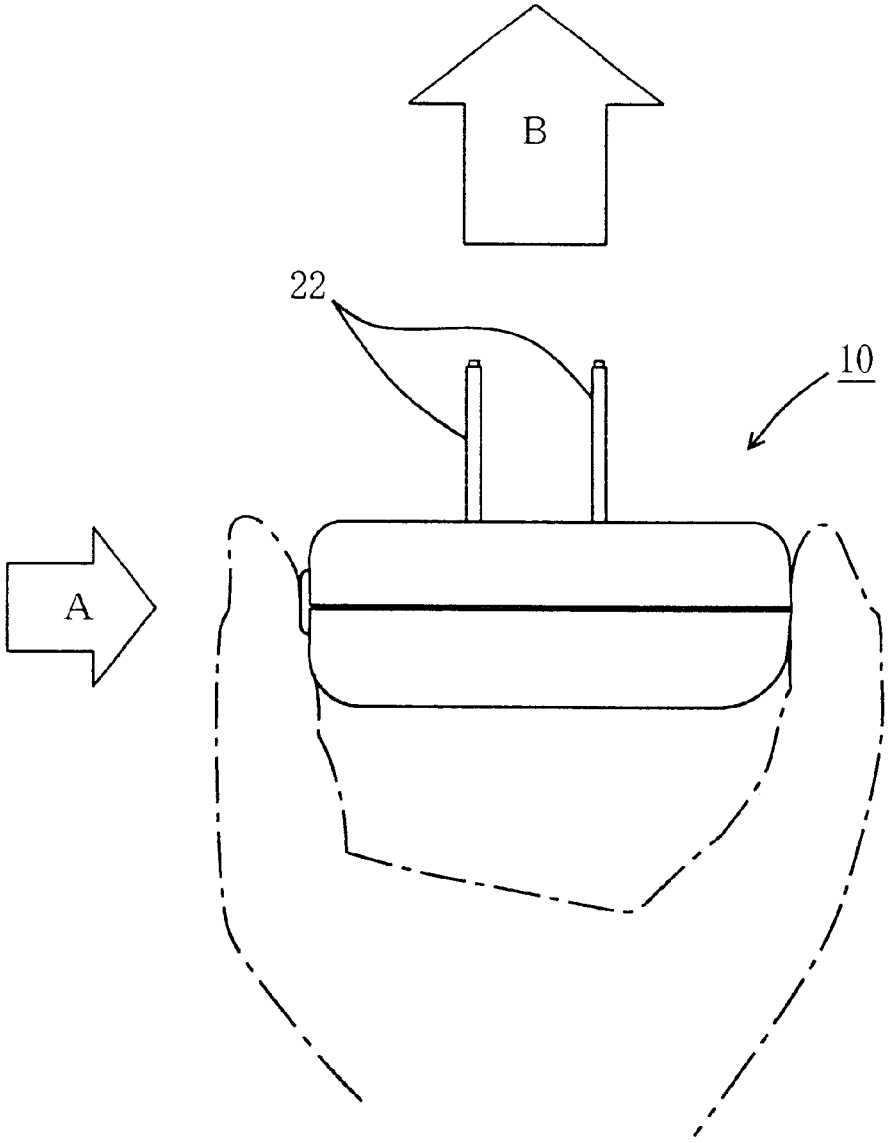
FIG. 9 is a view that assists the explanation of the power plug assembly of FIG. 1 being plugged into an AC outlet.

To plug-in the AC plug 10 into the AC outlet, as shown in FIG. 9, the button 30 is first pushed in a direction denoted by an arrow A. Then, the terminals 22 are inserted into the AC outlet in a direction denoted by an arrow B (direction leading to the AC outlet). To pull the AC plug 10 out from the AC outlet, conversely, the AC plug 10 should be pulled out in the opposite direction to the arrow B regardless whether the button 30 is pushed or not.

Since the plug 20 is held in the housed-in state only by the spring 25, the plug 20 can be easily pivotally moved so that the terminals 22 are lifted up by 90 degrees. The plug 20 has a structure so that the terminals 22 do not remain lifted up unless a user pivotally moves the plug 20 by 90 degrees and then pushes the button 30. Without the user's intervention, the plug 20 is put back in the housed-in state immediately after being pulled out from the AC outlet, and thus the terminals 22 never inappropriately remain exposed. Therefore, the terminals 22 are prevented from bumping against something.

According to the present invention, since a force acts in a direction to house the plug 20 unless otherwise intervened by a user, the plug 20 never remains exposed when not in use. Therefore, a power plug assembly of the present invention is free from malfunction.

Further, in the power plug assembly of the present invention, engagement members abut against each other in a limited fashion. Accordingly, even while being repeatedly plugged-in and pulled-out, a part where the engagement members abut does not wear out. Even if it becomes worn out to some extent, the protruded part of an engagement member can be manually pushed so that engagement is appropriately adjusted.

While the invention has been described in detail, the foregoing description is in all aspects illustrative and not restrictive. It is understood that numerous other modifications and variations can be devised without departing from the scope of the invention.

What is claimed is:

1. A power plug assembly provided for an electronic device plugged into an AC outlet, comprising:

a plug formed in one piece with a pair of terminals to be inserted into the AC outlet, and made of insulating material;

a case which has a space retaining said plug so that said plug is pivotally movable in a predetermined angular range, exposing said terminals when the plug pivotally moves, and housing the terminals when not in use;

a first resilient member housed in said case, and always biasing said plug in a direction so that said plug is housed;

a first engagement part formed in said plug;

a second engagement part to be engaged with said first engagement part when said plug is pivotally moved to a predetermined angle of said predetermined angular range forced against said first resilient member;

engagement operator for engaging said second engagement part with said first engagement part; and a second resilient member for always biasing said engagement operator in a direction having engagement of said second engagement part with said first engagement part released, wherein when said plug is pivotally moved to the predetermined angle, said engagement operator is operated with a force against a resilience of said second resilient member so that said first and second engagement parts are engaged with each other and the plug is retained in a state ready for plug-in into the AC outlet, and when the engagement operator is released, the plug is automatically housed in said space due to resilience of said first resilient member.

2. The power plug assembly according to claim 1, wherein said plug has an axis to pivotally move thereon, and said first resilient member is a spring being wound around said axis.

3. The power plug assembly according to claim 1, wherein said first engagement part is a recess, and said second engagement part is a pin formed to be inserted into said first engagement part.

4. The power plug assembly according to claim 1, wherein said second engagement part and said engagement operator are integrated to be one piece, and said engagement operator is partially exposed from said case.

5. The power plug assembly according to claim 1, wherein said plug is pivotally movable in a range of 90 degrees with respect to said case.

6. A power plug assembly comprising:

a case;

a plug having a pair of terminals, said plug being pivotally mounted within said case so that terminals are housed within said case when said plug is arranged at a first angular position and extend beyond said case when said plug is arranged at a second angular position;

a first biasing member coupled to said plug to always bias said plug into said first angular position;

an operational mechanism coupled to said plug;

wherein after said plug is pivotally moved to the second angular position, a force must be exerted on said operational mechanism to retain said plug in said second angular position, and the plug is automatically returned to the first angular position by said first biasing member when said force exerted on said operation mechanism is released.

7. The power plug assembly of claim 6, wherein said first biasing member includes a wound spring which is coupled to said plug.

8. The power plug assembly of claim 6, wherein said operational mechanism includes a first engagement part and a second engagement part, wherein said second engagement part engages said first engagement part when said force is exerted on said operational mechanism to retain the plug in said second angular position.

9. The power plug assembly of claim 8, wherein said operational mechanism further includes a second biasing member which prevents said second engagement part from being engaged with said first engagement part unless said force is exerted on said operational mechanism.

10. The power plug assembly of claim 8, wherein said first engagement part is formed by a recess in said plug and said second engagement part is formed by a pin which is capable of being inserted into said recess.

11. The power plug assembly of claim 6, wherein the first angular position and the second angular position are separated by approximately 90 degrees.

12. A power plug assembly comprising:

a case;

a plug having a pair of terminals, said plug being pivotally mounted within said case so that said terminals are housed within said case when said plug is arranged at a first angular position and extend beyond said case when said plug is arranged at a second angular position;

a first biasing member coupled to said plug to always bias said plug into said first angular position;

wherein said plug is capable of being moved from said first angular position to said second angular position against a biasing force exerted by said first biasing member on said plug.

13. The power plug of claim 12, further comprising an operational mechanism coupled to said plug, wherein a force is be exerted on said operational mechanism after said plug is moved from said first angular position to said second angular position to retain the plug in said second angular position.

14. The power plug of claim 13, wherein:

said terminals of the plug are capable of being inserted into an AC outlet when the plug is in said second angular position; and said plug will automatically return to said first angular position from said second angular position through said biasing force exerted by said biasing member if said force is not exerted on said operational mechanism and said terminals are not inserted in said AC outlet.

15. The power plug assembly of claim 12, wherein said first biasing member includes a wound spring which is coupled to said plug.

16. The power plug assembly of claim 13, wherein said operational mechanism includes a first engagement part and a second engagement part, wherein said second engagement part engages said first engagement part when said force is exerted on said operational mechanism to retain the plug in said second angular position.

17. The power plug assembly of claim 16, wherein said operational mechanism further includes a second biasing member which prevents said second engagement part from being engaged with said first engagement part unless said force is exerted on said operational mechanism.

18. The power plug assembly of claim 16, wherein said first engagement part is formed by a recess in said plug and said second engagement part is formed by a pin which is capable of being inserted in said recess.

19. The power plug of claim 12, wherein the first angular position and the second angular position are separated by approximately 90 degrees.

* * * * *